US006354460B1

(12) United States Patent
Cornell et al.

(10) Patent No.: US 6,354,460 B1
(45) Date of Patent: Mar. 12, 2002

(54) BEVERAGE CONTAINER WITH SELF-CONTAINED DRINKING STRAW

(75) Inventors: Stephen W. Cornell, Naperville, IL (US); Peter F. Murphy, Grosse Pointe, MI (US)

(73) Assignee: The PopStraw Company, LLC, Roseville, MI (US)

( * ) Notice: Subject to any disclaimer, the term of this patent is extended or adjusted under 35 U.S.C. 154(b) by 0 days.

(21) Appl. No.: 09/507,760

(22) Filed: Feb. 18, 2000

Related U.S. Application Data

(63) Continuation-in-part of application No. 09/253,334, filed on Feb. 22, 1999, now Pat. No. 6,095,368, which is a continuation-in-part of application No. 08/992,654, filed on Dec. 17, 1997, now Pat. No. 6,000,573, which is a continuation-in-part of application No. 08/856,838, filed on May 15, 1997, now Pat. No. 5,819,979.

(51) Int. Cl.[7] ..... A47G 19/22
(52) U.S. Cl. ..... 220/706; 220/705
(58) Field of Search ..... 220/705, 706, 220/707; 215/388, 389

(56) References Cited

U.S. PATENT DOCUMENTS 3,263,855 A 8/1966 Pugh, Sr.
3,295,715 A 1/1967 Pugh (List continued on next page.)

FOREIGN PATENT DOCUMENTS

| | | |
|---|---|---|
| DE | 2650488 A1 | 5/1978 |
| FR | 2590237 A | 11/1985 |
| FR | 2615487 | 11/1988 |
| FR | 2627753 | 9/1989 |
| JP | 3-98877 | 4/1991 |
| JP | 4-44955 | 2/1992 |
| JP | 4-72149 | 3/1992 |
| WO | WO 85/04850 | 11/1985 |

*Primary Examiner*—Stephen Castellano
(74) *Attorney, Agent, or Firm*—Harness, Dickey & Pierce, P.L.C.

(57) ABSTRACT

A beverage container has a straw-dispensing mechanism that is disposed within the container to bring the straw into alignment with the orifice in the top of the container. When the orifice is opened, the straw elevates through the orifice to become accessible to the user. The straw engages a floating member which is located adjacent to the lid of the container when the container is filled with a fluid. The floating member includes a contoured or cam surface which is engaged by the opening tab of the container to rotate the floating member until the straw aligns with the opening. Various design configurations for the floating member are disclosed.

31 Claims, 8 Drawing Sheets

U.S. PATENT DOCUMENTS 3,349,955 A 10/1967 Cornelius
3,547,308 A 12/1970 Gillieon
3,656,654 A 4/1972 Brinkley, III
3,717,476 A 2/1973 Harvey
3,746,197 A 7/1973 Sather
3,776,458 A 12/1973 Chunga
3,946,895 A 3/1976 Pugh
4,078,692 A 3/1978 Stein
4,109,817 A 8/1978 Payne et al.
4,226,356 A 10/1980 Lemelson
4,228,913 A 10/1980 Mack et al.
4,305,521 A 12/1981 Komatsuta et al.
4,356,927 A 11/1982 Cooper et al.
4,424,913 A 1/1984 Ko
4,462,503 A 7/1984 DiRaffaele et al.
4,537,324 A 8/1985 Wang
4,561,557 A 12/1985 Park et al.
4,582,213 A 4/1986 Park et al.
4,690,294 A 9/1987 Jones
4,709,829 A 12/1987 Johnson et al.
4,712,702 A 12/1987 Ayabe et al.
4,728,001 A 3/1988 Serba
4,826,034 A 5/1989 Forbes
4,842,157 A 6/1989 Stone-Parker et al.
4,877,148 A 10/1989 Larson et al.
4,892,187 A 1/1990 Stein
4,923,083 A 5/1990 Forbes
4,923,084 A 5/1990 Forbes
4,925,040 A 5/1990 Wang
4,930,652 A 6/1990 Murphy et al.
4,948,008 A 8/1990 Wu et al.
5,054,639 A 10/1991 Ahn
5,080,247 A 1/1992 Murphy et al.
5,160,058 A 11/1992 Ahn
5,172,827 A 12/1992 Chang et al.
5,174,469 A 12/1992 Policapelli
5,244,112 A 9/1993 Murphy et al.
5,253,779 A 10/1993 Lee
5,547,103 A 8/1996 Murphy et al.
5,819,972 A 10/1998 Pubill
5,819,979 A 10/1998 Murphy et al.
5,848,721 A * 12/1998 Cornell et al. ..... 220/706
5,975,340 A * 11/1999 Cornell et al. ..... 220/706
6,000,573 A * 12/1999 Murphy et al. ..... 220/710
6,056,149 A * 5/2000 Murphy et al. ..... 220/705
6,095,368 A * 8/2000 Cornell et al. ..... 220/709
6,123,219 A * 9/2000 Cornell et al. ..... 220/705
6,158,611 A * 12/2000 Cornell et al. ..... 220/706
6,193,101 B1 * 2/2001 Murphy et al. ..... 220/706

* cited by examiner

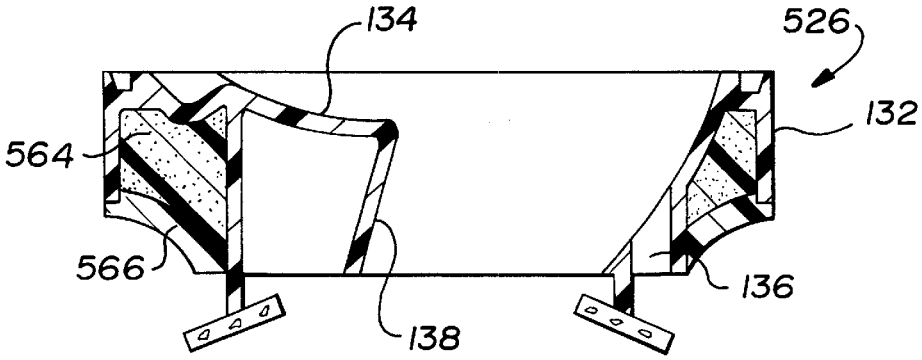
Fig-17
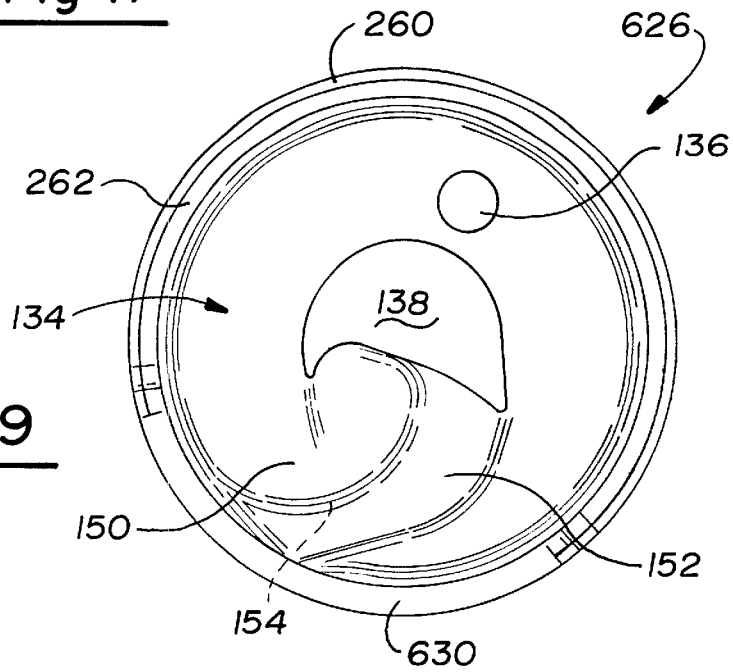
Fig-19
Fig-18
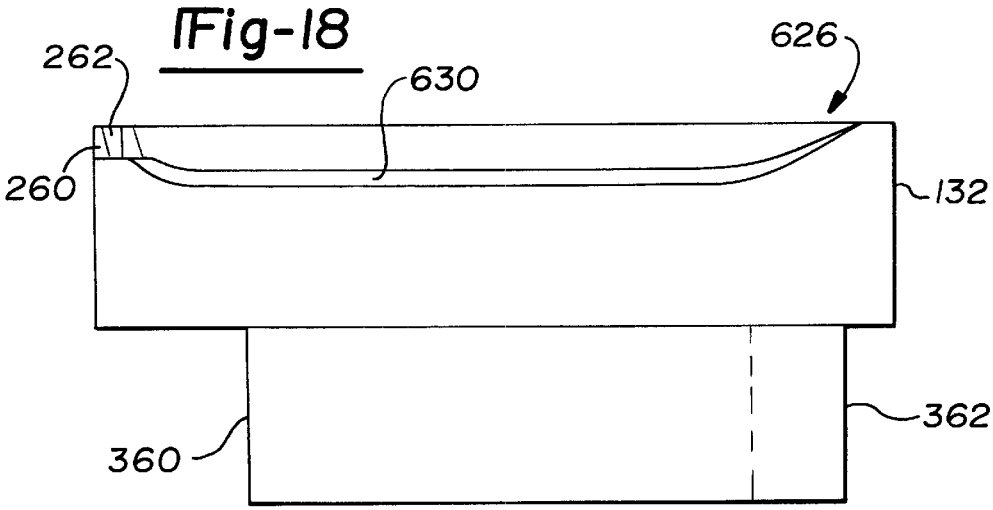

BEVERAGE CONTAINER WITH SELF-CONTAINED DRINKING STRAW

CROSS-REFERENCE TO RELATED APPLICATIONS

This application is a continuation-in-part of U.S. application Ser. No. 09/253,334, filed Feb. 22, 1999, now U.S. Pat. No. 6,095,368 which is a CIP of application Ser. No. 08/992,654, filed Dec. 17, 1997, now U.S. Pat. No. 6,000,573, which is a continuation in part of U.S. application Ser. No. 08/856,838, filed May 15, 1997, now U.S. Pat. No. 5,819,979.

FIELD OF THE INVENTION

The present invention relates to beverage containers having a self-contained straw. More particularly, the present invention relates to beverage containers having a self-contained straw which becomes accessible to the user when the beverage container is opened.

BACKGROUND AND SUMMARY OF THE INVENTION

Currently, beverage containers are manufactured, filled, and sealed in a high-speed automated process. This process includes manufacturing a separate body for containing the fluid or beverage and a separate lid for sealing the open end of the body. During manufacture of the filled beverage container, a manufacturing operation known as "seaming" places the lid on a filled can body and seals its perimeter. At present, known seaming operations pass the lids horizontally across the top of the filled can bodies at a vertical distance of only a few millimeters above the top edge of the can body. Once positioned on top of the can body, the seaming operation seals the fluid or beverage within the beverage container. This seaming operation involves the use of very expensive high-speed machinery and tooling or retooling this high-speed machinery to accommodate a self-contained drinking straw is not a practical solution.

Various designs have been proposed in the prior art for placing a straw within a beverage can that becomes accessible to the user when the tab in the lid of the can is deflected into the interior to open the can. The vast majority of these designs can be categorized into two groups. The first group comprises designs wherein the straw is installed within the can so as to be prealigned with the tab opening. Thus, when the tab is opened, access to the straw is presented. The practical disadvantage with this approach is that the bodies and lids of the cans are randomly oriented during the present day seaming operations. Consequently, any design that requires prealignment of the straw with the opening in the lid is not readily adaptable to the existing high-speed filling equipment.

The second group of designs generally involves the mounting or attachment in some manner of the straw to the underside of the lid such that when the can is opened, the end of the straw is drawn through or otherwise made accessible through the opening. These designs are also not readily adaptable to the existing high-speed filling canning equipment due to the fact, as noted above, that the commercial filling processes pass the lid within a few millimeters of the top of the can during the high-speed seaming operation. Consequently, any structure that is attached or otherwise appended to the underside of the lid will disrupt the seaming process and thus require expensive retooling of the existing high-speed machinery.

A different approach for this concept is disclosed in U.S. Pat. No. 5,547,103 which is assigned to the assignee of the present invention. This patent discloses various embodiments of a beverage container having a straw-dispensing mechanism that relies upon user manipulation of the container and the forces of gravity to bring the straw into alignment with the opening in the lid. The user merely tilts the beverage container, preferably prior to opening, to cause the mechanism within the container to bring the straw into general alignment with the tab. Once the container is opened, further minor manipulation or tilting of the container may be necessary to complete the alignment of the straw with the open orifice in the lid.

Yet another approach for this concept is disclosed in U.S. Pat. Nos. 5,244,112; 5,080,247 and 4,930,652 which are also assigned to the assignee of the present invention. These patents describe various embodiments of a straw-dispensing mechanism that is disposed within the body of the container which operate to rotate the straw into alignment beneath the open orifice of a beverage container. In particular, these designs respond to the inward deflection of the closure tab into the body of the container to actuate or drive a rotating mechanism which aligns the straw with the open orifice. While these designs remain technologically and commercially viable, the continued development of straw-dispensing mechanisms is directed to simpler and lower cost mechanisms which can be relied upon to consistently align the drinking straw with the open orifice in the beverage can once the orifice in the beverage can has been opened. Also, continued development is directed to alternative mechanisms for temporarily securing straw dispensing mechanisms within the container so as to not interfere with the filling and seaming processes.

In this regard, the present invention discloses a beverage container having a straw-dispensing mechanism which includes a contoured or shaped cam surface which operates to cause rotation of the drinking straw to align the drinking straw with the orifice. One embodiment of the present invention employs a float which supports and positions the drinking straw at a distance radially which is equal to the radial position of the orifice in the can lid. A contoured or cam surface located on the interior surface of the lid of the can guides the drinking straw into alignment with the orifice in the can.

Another embodiment employs a float which supports and positions the drinking straw at a distance radially which is equal to the radial position of the orifice in the can lid. A contoured or cam surface located on the upper surface of the float reacts with the inward deflected tab upon opening of the beverage can to rotate the drinking straw to a position in alignment with the now open orifice. Various design configurations for this float with the contoured or cam surfaces are disclosed.

Thus, it is an object of the present invention to provide a beverage container with a self-contained straw-dispensing mechanism that is compatible for manufacture with existing filling equipment.

In addition, it is an object of the present invention to provide such a beverage container with a self-contained straw-dispensing mechanism that is simple in design, utilizes a minimum of material, is inexpensive to manufacture, and requires relatively inexpensive equipment to assemble and insert into the beverage containers.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 17 is a vertical sectional view of a floating disk similar to that shown in FIG. 15 but in accordance with another embodiment of the present invention.

FIG. 18 is a side view of a floating disk similar to that shown in FIG. 10 but in accordance with another embodiment of the present invention;

FIG. 19 is a top view of the floating disk shown in FIG. 18;

DETAILED DESCRIPTION OF THE PREFERRED EMBODIMENTS

Figure 1:
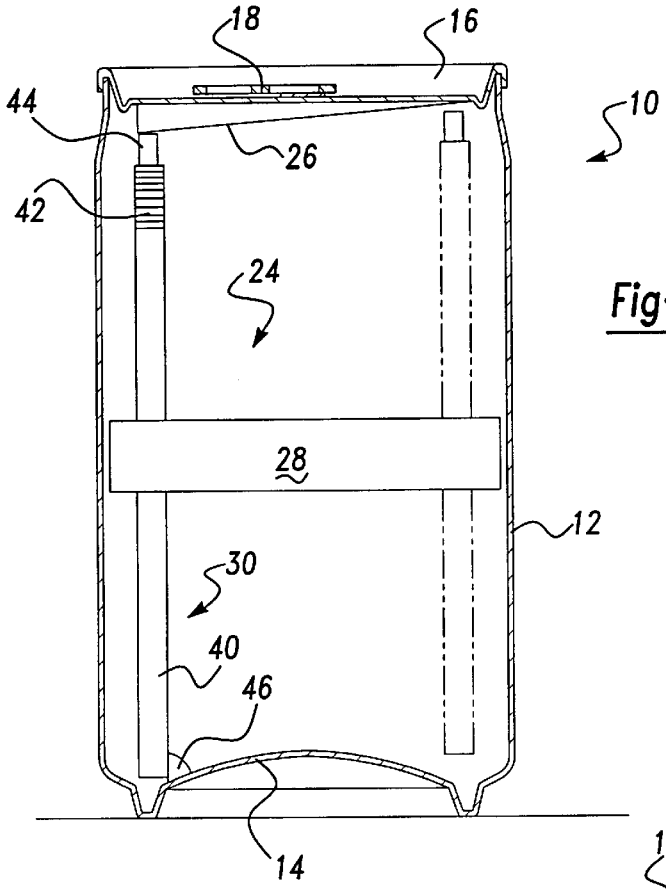
FIG. 1 is a vertical sectional view of a beverage can containing a straw-dispensing mechanism according to the present invention.
Figure 2:
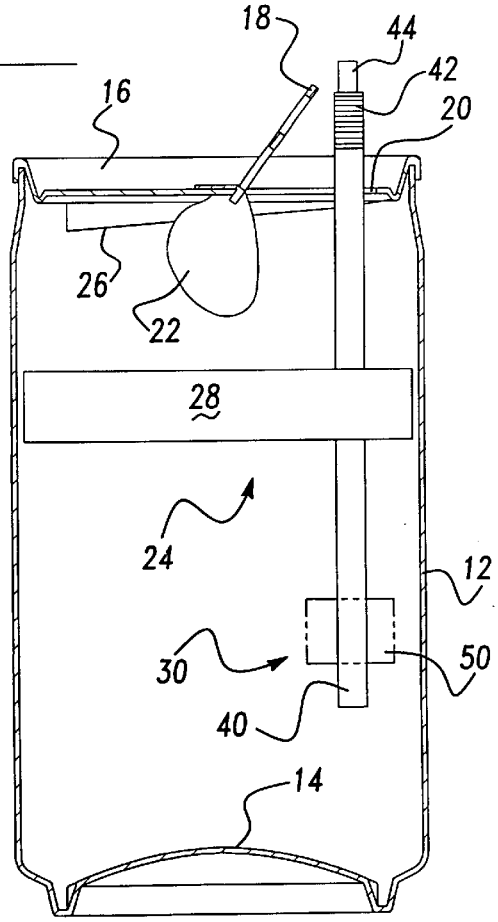
FIG. 2 is a vertical sectional view of the beverage can shown in FIG. 1 illustrating the straw ascending through the orifice in the lid of the can.
Figure 3:
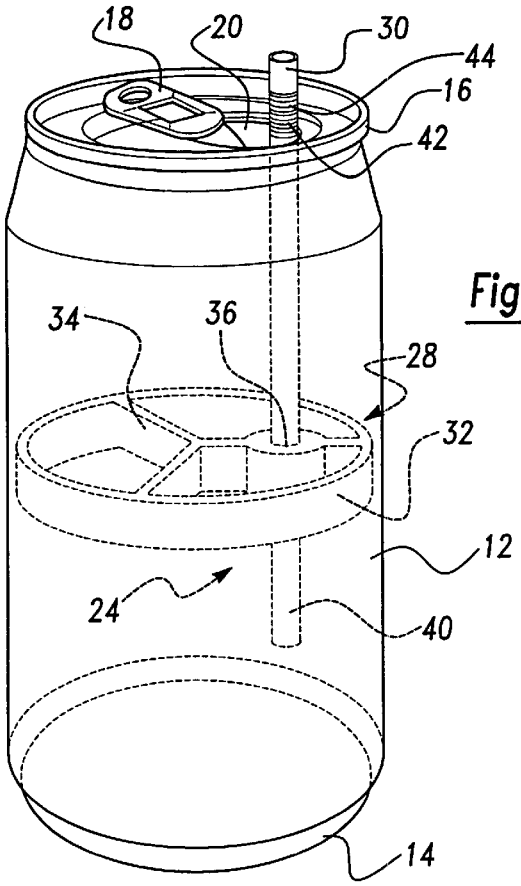
FIG. 3 is a front perspective view of the beverage can shown in FIGS. 1 and 2 illustrating the straw in the extended position.

Referring now to the drawings in which like reference numerals designate like or corresponding parts throughout the several views, there is shown in FIGS. 1–3 a beverage can having a straw dispensing mechanism in accordance with the present invention which is designated generally by reference numeral 10. Beverage can 10 comprises an aluminum, steel or plastic container having a cylindrical body 12 with a closed bottom 14 and an upper lid 16. Lid 16 is joined to body 12 using a seaming operation as is well known in the art. Lid 16 includes an actuating member or lever ring 18 pivotally secured to lid 16. Lever ring 18 is adapted when actuated to open an orifice 20 in lid 16 by deflecting a closure tab 22 into the interior of beverage can 10. Closure tab 22 is formed by score lines in lid 16 which enable a controlled portion of closure tab 22 to break free from lid 16 when lever ring 18 is actuated against tab 22 by an individual. As the user lifts one end of ring 18 to its maximum extent, the opposite end pushes against closure tab 22. Alternatively, the tab could be designed to brake free when depressed by the user's finger or by the use of a portable tool. In these types of closure tabs, lever ring 18 may be omitted. Closure tab 22 is typically designed via the score lines to deflect downwardly and toward one side of orifice 20 to fully open orifice 20 and facilitate the free flow of liquid from beverage can 10 through orifice 20.

Beverage can 10 further comprises a straw dispensing mechanism 24 which is comprised of a contoured or cam surface 26 located on the inside of lid 16, a buoyant member or float 28 and a drinking straw 30. Contoured or cam surface 26 is formed by lid 16 and is angled towards orifice 20 in order to guide straw 30 into alignment with orifice 20. Surface 26 may be formed into lid 16 with the reverse of the contoured surface being located on the top surface of lid 16 if desired or contoured surface 26 may be formed by a separate insert placed within beverage can 10.

Buoyant member 28 is manufactured from a material which will float within the liquid contained inside beverage can 10 and thus provide sufficient buoyant force (when liquid is present in beverage can 10) to cause straw 30 to be urged against contoured surface 26 and eventually to ascend through orifice 20 in can lid 16 when straw 30 is in alignment with orifice 20.

Buoyant member 28 is a circular member which includes an outer ring 32, a plurality of ribs 34 and a straw aperture 36. Outer ring 32 is an annular member which has an outer surface which is sized slightly smaller than the internal diameter of can body 12. Thus, outer ring 32 is free to move axially within beverage can 10. The height of outer ring 32 is sized to work in conjunction with straw 30 to limit the tilting of outer ring 32 in order to maintain straw 30 in a generally vertical position as shown in the drawings. The plurality of ribs 34 extend inwardly from outer ring 32 to meet at the center defined by outer ring 32. Ribs 34 provide rigidity to outer ring 32 and while three ribs 34 are shown in FIGS. 1–3, any suitable number of ribs may be utilized. During filling of beverage can 10, the plurality of ribs 34 permit filling of the volume of beverage can 10 located below buoyant member 28. One of the plurality of ribs 34 forms straw aperture 36. The radial positioning of aperture 36 along rib 34 positions aperture 36 in direct alignment with orifice 20 when aperture 36 is circumferentially aligned with orifice 20.

Drinking straw 30 includes a lower tubular portion 40, a pull-out flexible convoluted section 42 and an upper tubular portion 44. Lower tubular portion 40 of drinking straw 30 extends through aperture 36 in buoyant member 28. Aperture 36 frictionally receives straw 30 such that vertical movement of buoyant member 28 within beverage can 10 causes vertical movement of straw 30. Alternatively, a buoyant member 50 (shown in phantom in FIG. 2) may be attached to straw 30 or straw 30 can be manufactured from a buoyant material to provide the necessary buoyancy to straw 30.

FIG. 1 illustrates beverage can 10 and straw dispensing mechanism 24 immediately after the filling and seaming operation have been performed. Drinking straw 30 extends from bottom 14 of can body 12 vertically upward through aperture 36 of buoyant member 28 towards lid 16. The circumferential positioning of straw 30 in relation to orifice 20 occurs randomly due to the filling and seaming processes for beverage can 10. To prevent buoyant member 28 from elevating straw 30 during the can filling and seaming processes, and thus possibly interfering with these processes, a small amount of soluble adhesive 46 such as glucose or thixotropic gel, is preferably applied to temporarily bond straw 30 to can body 12 or closed bottom 14. Accordingly, after the filling and seaming processes are complete, adhesive 46 will gradually dissolve and thereby enable buoyant member 28 and straw 30 to float freely upward until straw 30 contacts contoured surface 26 on the underside of lid 16. During the subsequent handling of beverage can 10, straw 30 will react with contoured surface 26 to rotate buoyant member 28 and straw 30 until it is aligned with orifice 20 as shown in phantom in FIG. 1. The reaction between straw 30 and contoured surface 26 occurs due to the buoyant force exerted on straw 30 by buoyant member 28. Straw 30 will have a tendency to align with orifice 20 due to the ramping of contoured surface 26 towards orifice 20 regardless of the direction of rotation of buoyant member 28.

FIG. 2 illustrates beverage can 10 and straw dispensing mechanism 24 after lever ring 18 has pushed closure tab 22 into the interior of beverage can 10 to open orifice 20. Depending on the circumferential position of straw 30, in relation to orifice 20, the opening of orifice 20 may or may not result in contact between closure tab 22 and straw 30. Any contact between closure tab 22 and straw 30 will cause rotation of buoyant member 28 and straw 30 to slightly misalign straw 30 with orifice 20. This misalignment will be corrected once closure tab 22 is completely deflected to fully open orifice 20 by the interaction between straw 30 and contoured surface 26 as detailed above. Once straw 30 is aligned with orifice 20, the buoyant force on buoyant member 28 will push straw 30 upward through orifice 20 to provide accessibility to straw 30 for the user of beverage can 10.

At this point, the user may elect to commence drinking through straw 30 or withdraw straw 30 further through orifice 20 in lid 16. Buoyant member 28 is formed with sufficient rigidity and the frictional interface between straw 30 and aperture 36 of buoyant member 28 is sufficiently low to permit straw 30 to be pulled upward through buoyant member 28 as buoyant member 28 is held against the underside of lid 16. Convoluted section 42 can be extended regardless of whether or not straw 30 extends through aperture 36, to allow the user to extend the length of straw 30 so that the other end of straw 30 reached fully to the bottom 14 of beverage can 10 while upper portion 44 remains accessible through orifice 20.

Figure 3A:
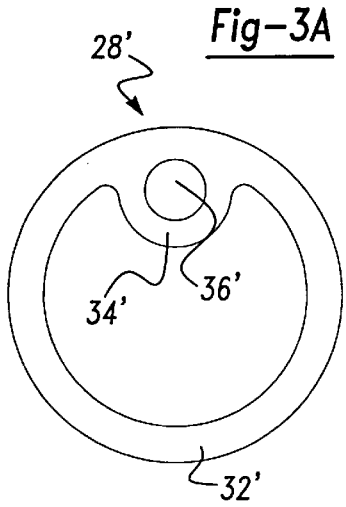
FIG. 3A is a plan view of a buoyant member in accordance with another embodiment of the present invention.

FIG. 3A illustrates a buoyant member 28' in accordance with another embodiment of the present invention. Buoyant member 28' comprises an outer ring 32', a radially inwardly disposed embossment 34' and a straw aperture 36'. Buoyant member 28' is a direct replacement for buoyant member 28.

Figure 4:
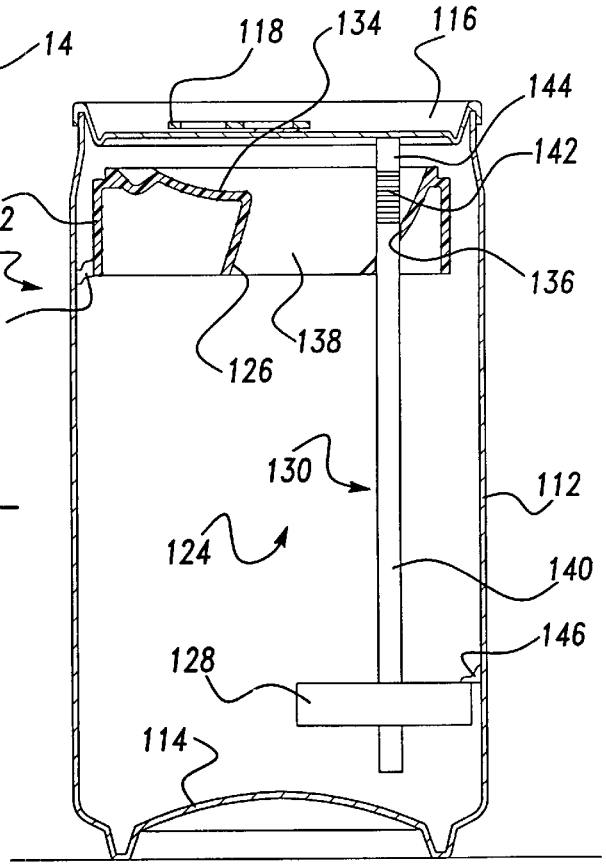
FIG. 4 is a vertical sectional view of a beverage can containing a straw-dispensing mechanism according to another embodiment of the present invention.
Figure 5:
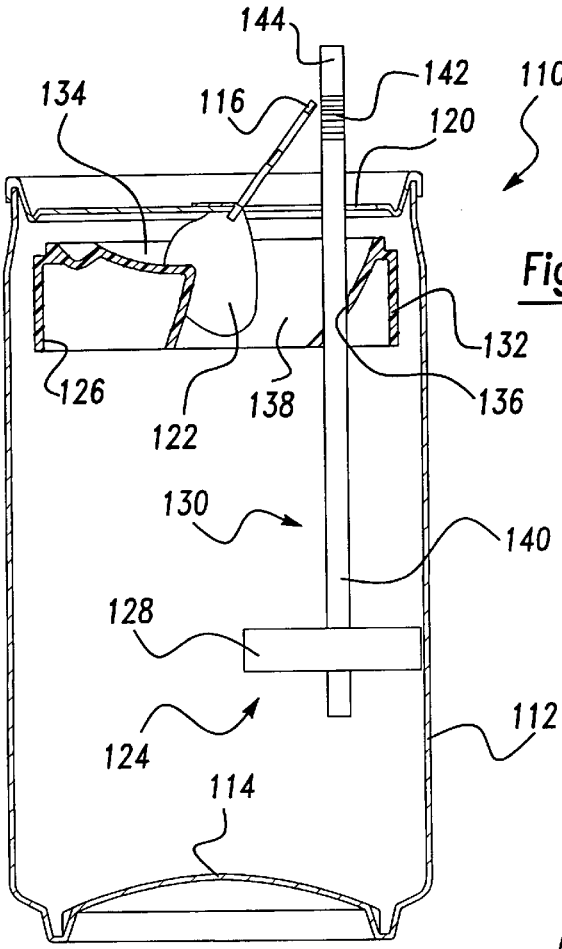
FIG. 5 is a vertical sectional view of the beverage can as shown in FIG. 4 illustrating the straw ascending through the orifice in the lid of the can.
Figure 6:
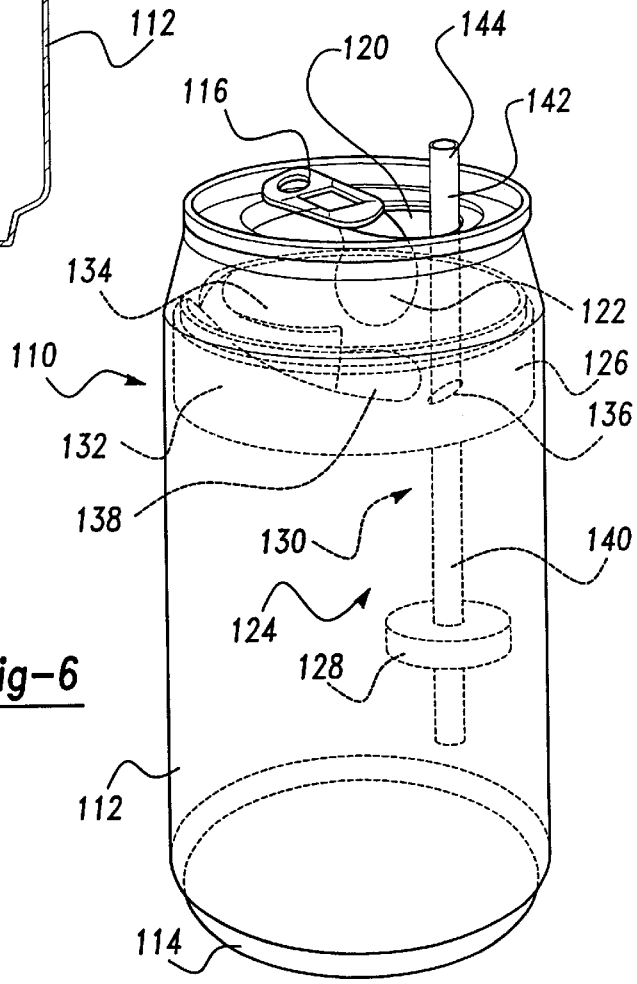
FIG. 6 is a front perspective view of the beverage can shown in FIGS. 4 and 5.

Referring now to FIGS. 4 through 6 there is shown a beverage can having a straw dispensing mechanism in accordance with another embodiment of the present invention which is designated generally by reference numeral 110. Beverage can 110 comprises an aluminum, steel or plastic container having a cylindrical body 112 with a closed bottom 114 and an upper lid 116. Lid 116 is joined to body 112 using a seaming process as is well known in the art. Lid 116 includes an actuating member or lever ring 118 pivotally secured to lid 116. Lever ring 118 is adapted when actuated to open an orifice 120 in lid 116 by deflecting a closure tab 122 into the interior of beverage can 110. Closure tab 122 is formed by score lines in lid 116 which enable a controlled portion of closure tab 122 to break free from lid 116 when lever ring 118 is actuated against tab 122 by a user. As the user lifts one end of ring 118, the opposite end pushes against closure tab 122. Alternatively, the tab could be designed to break free when depressed by the user's finger or by the use of a portable tool. In these types of closure tabs, lever ring 118 may be omitted. Closure tab 122 is typically designed via the score lines to deflect downwardly and towards one side of orifice 120 to fully open orifice 120 and facilitate the free flow of liquid from beverage can 110 through orifice 120.

Beverage can 110 further comprises a straw dispensing mechanism 124 which is comprised of a floating member 126, a buoyant member 128 and a drinking straw 130. Floating member 126 defines an outer cylindrical wall or skirt 132, a contoured or cam surface 134 and a straw aperture 136.

Floating member 126 is manufactured from a material which will float within the liquid contained inside beverage can 110 and thus will position itself adjacent to lid 116 in a filled beverage can 110. Outer cylindrical wall 132 of floating member 126 is sized slightly smaller than the internal diameter of can body 112. Thus, floating member 126 is free to move axially within beverage can 110 and will be urged against lid 116 due to the buoyant force acting on floating member 126. The height of wall 132 is chosen to work in conjunction with straw 130 to limit the tilting of floating member 126 in order to maintain straw 130 in a generally vertical position as shown in the drawings. Aperture 136 extends vertically through floating member 126. The radial positioning of aperture 136 positions aperture 136 in direct vertical alignment with orifice 120 when aperture 136 is circumferentially aligned with orifice 120. A centrally located aperture 138 allows for the filling of the volume of beverage can 110 located below floating member 126. Alternatively, additional passages through floating member 126 or the clearance between floating member 126 and the interior of can body 112 may be used to facilitate the filling of beverage can 110.

Drinking straw 130 includes a lower tubular portion 140, a pull-out flexible convoluted section 142 and an upper tubular portion 144. Lower tubular portion 140 of drinking straw 130 extends through aperture 136 in floating member 126. Aperture 136 is slightly larger than lower tubular portion 140 and thus slidingly receives lower tubular portion 140. Thus, floating member 126 is free to move vertically within beverage can 110 with respect to straw 130. Buoyant member 128 is attached to the lower end of lower tubular portion 140 to urge straw 130 in an upward direction. The diameter of buoyant member 128 is chosen such that when the outer edge of buoyant member 128 is in contact with the inside wall of can body 112, straw 130 is positioned generally vertically within beverage can 110. Thus, buoyant member 128 will act as a torque arm to reduce the amount of tilting of floating member 126 during the opening of beverage can 110 as will be described later herein.

FIG. 4 illustrates beverage can 110 and straw dispensing mechanism 124 immediately after the filling and seaming operation have been performed. Drinking straw 130 extends from bottom 114 of can body 112 vertically upward through aperture 136 of floating member 126 towards lid 116. The circumferential positioning of straw 130 in relation to orifice 120 (FIG. 5) occurs randomly due to the filling and seaming processes for beverage can 110. To prevent floating member 126, buoyant member 128 and straw 130 from elevating during the can filling and seaming processes, and thus possibly interfering with these processes, a small amount of soluble adhesive 146, such as glucose or thixotropic gel, is preferably applied to temporarily bond floating member 126 and buoyant member 128 to can body 112. Another option would be to locate floating member 126 toward the bottom 114 of can body 112. Floating member 126 would then retain both buoyant member 128 and straw 130 within beverage container 110. In addition, the location of floating member 126 toward the bottom of can body 112 would minimize the volume of beverage can 110 located below floating member 126 to simplify the filling operation. Accordingly, after the filling and seaming processes are complete, adhesive 146 will gradually dissolve and thereby enable floating member 126 to float upwardly to be urged against lid 116 and enable buoyant member 128 and straw 130 to float freely upward until straw 130 contacts lid 116 as shown in FIG. 4. The circumferential positioning of straw 130 in relation to orifice 120 occurs randomly due to both the filling and seaming processes and any rotation which may occur as floating member 126 moves upward from its retained position during filling to its position shown in FIG. 4.

FIG. 5 illustrates beverage can 110 and straw dispensing mechanism 124 after lever ring 118 has pushed closure tab 122 into the interior of beverage can 110 to open orifice 120. The deflection of closure tab 122 from its closed (generally horizontal) position as shown in FIG. 4 to its open (generally vertical) position as shown in FIG. 5 results in engagement between closure tab 122 and floating member 126 which imparts rotational movement to floating member 126, buoyant member 128 and straw 130. Floating member 126 will rotate until straw 130 is aligned with open orifice 120. When straw 130 is aligned with orifice 120, buoyant member 128 will push straw 130 upward through orifice 120 to provide accessibility to straw 130 by the user of beverage can 110.

At this point, the user may elect to commence drinking through straw 130 or withdraw straw 130 further from its orifice 120 in lid 116. Buoyant member 128 is formed with sufficient flexibility and the interface between straw 130 and buoyant member 128 is sufficiently strong to retain buoyant member 128 on straw 130 when straw 130 is pulled upward causing straw 130 and buoyant member 128 to pass through floating member 126. Alternatively, the buoyant member can be designed to separate from straw 130. This would require the size of the float to be such that it would not pass through orifice 120 or aperture 138. Convoluted section 142 can be extended regardless of whether or not straw 130 extends through aperture 136, to allow the user to reach fully to bottom 114 of beverage can 110.

Figure 7:
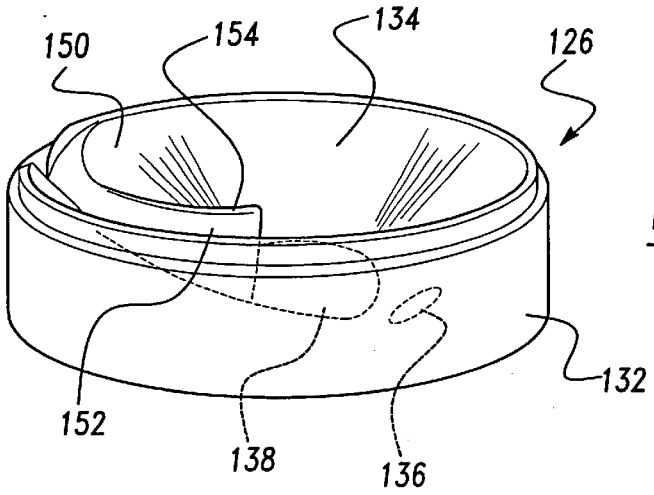
FIG. 7 is a perspective view of the floating disk shown in FIGS. 4–6.
Figure 8:
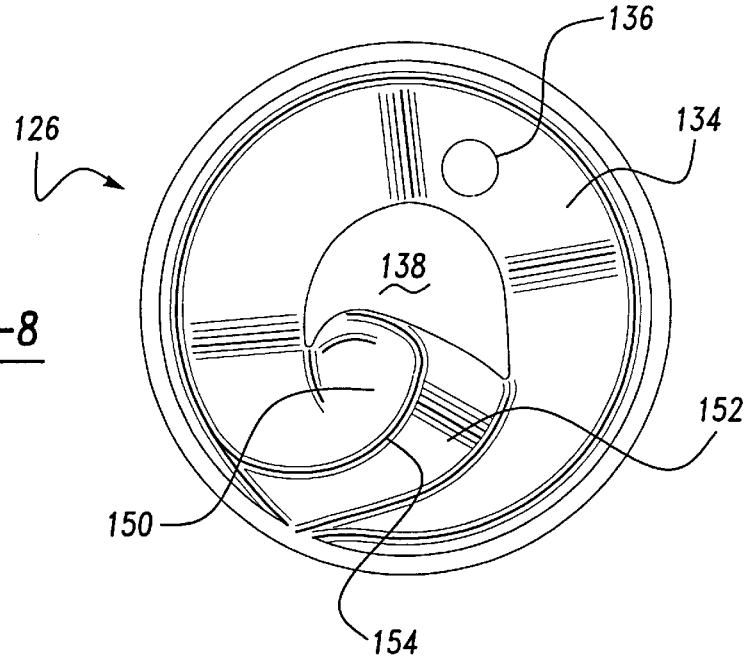
FIG. 8 is a plan view of the floating disk shown in FIG. 7.
Figure 9:
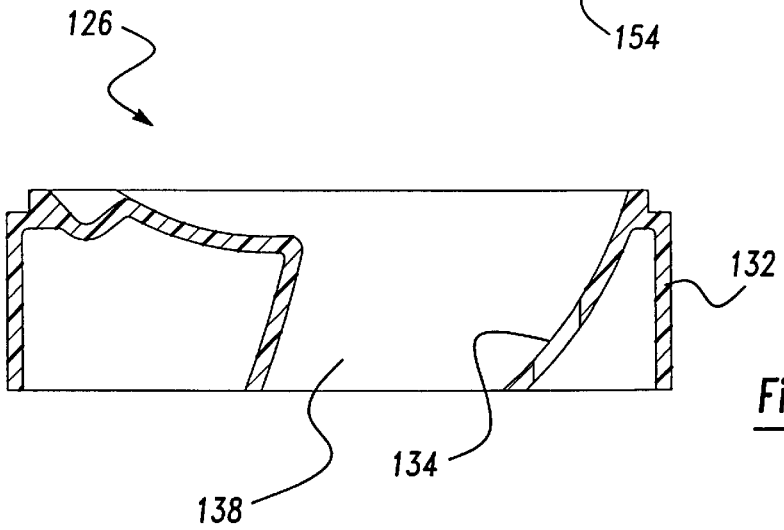
FIG. 9 is a vertical sectional view of the floating disk shown in FIGS. 7 and 8.

Referring now to FIGS. 7–9, floating member 126 is illustrated. Floating member 126 includes outer cylindrical wall 132, contoured or cam surface 134, straw aperture 136 and central aperture 138 as detailed above. Cam surface 134 defines a first contoured surface 150 and a second contoured surface 152. Contoured surfaces 150 and 152 form a bi-directional cam surface which will rotate floating member 126 clockwise or counterclockwise depending on whether contoured surface 150 or contoured surface 152 is engaged by closure tab 122 (FIG. 5). The incorporation of contoured surface 150 and contoured surface 152 limits the maximum amount of rotation of floating member 126 to about 180° in order to align straw 130 with orifice 120 (FIG. 5). A directional ridge 154 separates contoured surface 150 from contoured surface 152 at one end while the opposite ends of surfaces 150 and 152 blend together as shown in the drawings.

During the opening of beverage can 110, closure tab 122 engages either contoured surface 150 or 152 to impart rotational movement to floating member 126, buoyant member 128 and straw 130. In order to ensure rotational movement of floating member 126 and to avoid excessive tipping of floating member 126, straw 130 and buoyant member 128 may act as a torque arm to stabilize floating member 126 and limit the amount of its tipping. As detailed above, the diameter of buoyant member 128 is chosen such that when the outer circumferential edge of buoyant member 128 is in contact with the inside wall of can body 112, straw 130 is positioned generally vertically within beverage can 110. Any tilting of floating member 126 will be resisted by straw 130 and buoyant member 128 acting between the sidewall of can body 112 and the interior surface of aperture 136 of floating member 126. The use of straw 130 and buoyant member 128 as a torque arm allows for the shortening of the overall height of cylindrical wall 132 of floating member 126.

Figure 10:
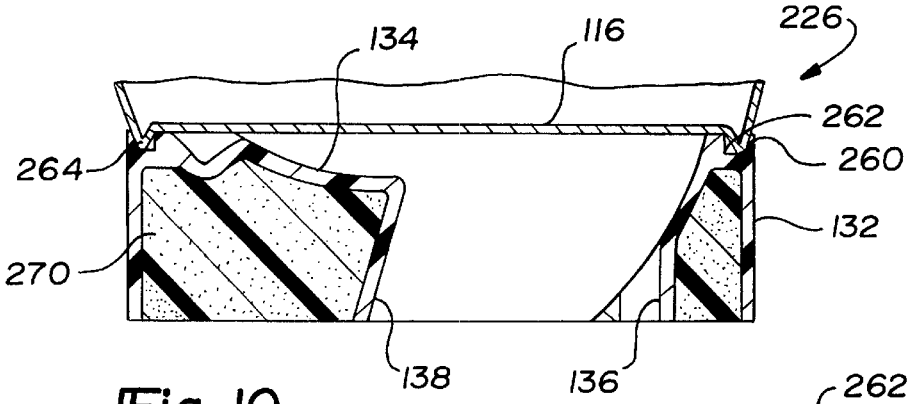
FIG. 10 is a vertical sectional view of a floating disk similar to that shown in FIG. 9 but in accordance with another embodiment of the present invention.
Figure 11:
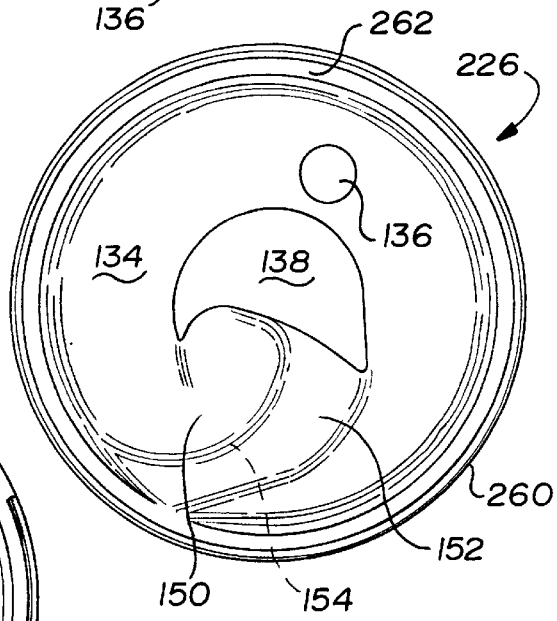
FIG. 11 is a top view if the floating disk shown in FIG. 10.

Referring now to FIGS. 10 and 11, there is shown a floating disk 226 in accordance with another embodiment of the present invention. Floating disk 226 includes outer cylindrical wall 132, contoured or cam surface 134, straw aperture 136 and central aperture 138. Cam surface 134 defines first contoured surface 150 and second contoured surface 152. Contoured surfaces 150 and 152 form a bi-directional cam surface which will rotate floating disk 226 clockwise or counter-clockwise depending on whether contoured surface 150 or contoured surface 152 is engaged by closure tab 122. The incorporation of contoured surface 150 and contoured surface 152 limits the maximum amount of rotation of floating disk 226 to a range from about 180° to about 210° or about 192° in order to align straw 130 with orifice 120. Ridge 154 separates contoured surface 150 from contoured surface 152 at one end while the opposite ends of surfaces 150 and 152 blend together as shown in the drawings.

Figure 12:
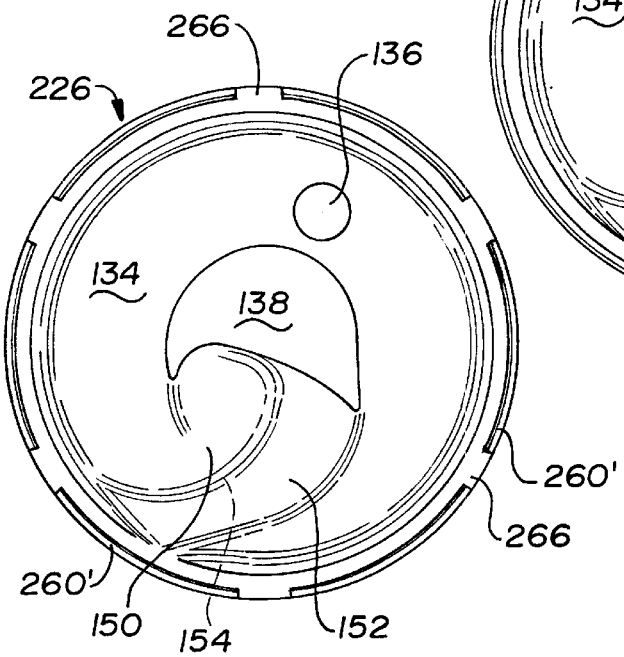
FIG. 12 is a top view similar to FIG. 11 but in accordance with another embodiment of the present invention.

When beverage can 110 is filled with the appropriate fluid, floating disk 226 will float to the top to engage lid 116 as shown in FIG. 10. An annular ridge 260 extends upward from outer cylindrical wall 132 to define an annular channel 262. Lid 216 is formed to define an annular flange 264 which nests within annular channel 262 as shown in FIG. 10. The nesting of annular flange 264 within annular channel 262 provides support for floating disk 226. When closure tab 122 engages contoured surface 150 or 152 of floating disk 226, this support of floating disk 226 will resist tipping of floating disk 226 within can 110 and thus will facilitate the imparting of rotational movement to disk 226 by closure tab 122. As shown in FIGS. 10 and 11, annular ridge 260 is a continuous ridge extending over the total circumference of disk 226. As shown in FIG. 12, annular ridge 260 may be replaced with annular ridge 260' which includes a series of gaps 266. Gaps 266 will reduce or eliminate any suction induced adhesion of disk 226 to lid 116.

One of the conditions that facilitates the operation of floating disk 226 as well as floating member 126 is that it be balanced with respect to the center of gravity and that the centroid of disk 226 lie on the same perpendicular bisector of the surface that mates with lid 116. Floating disk 226 is generally unbalanced due to the non-symmetry of contoured surfaces 150 and 152 and the inclusion of straw aperture 136. One method for balancing floating disk 226 is to design the wall thickness of the various portions of floating disk 226 such that a balanced disk is provided. Another method of balancing floating disk 226 is to purposefully incorporate a foam material 270 around the inside perimeter of the underside of floating disk 226 so that the center of gravity and the centroid of floating disk 226 are coincidental. Foam material 270 can be integrally molded beneath surfaces 150 and 152 using a blowing agent, direct gas injection or methods known to those skilled in the art. Foam material 270 is primarily used to provide floatation to floating disk 226, however, by controlling the thickness of material 270 in relation to the circumferential position of floating disk 226, a balanced floating disk 226 can be manufactured. In addition to balancing floating disk 226, foam material 270, due to its buoyancy, will also enhance the contact between floating disk 226 and lid 116 to improve the performance of floating disk 226.

Figure 13:
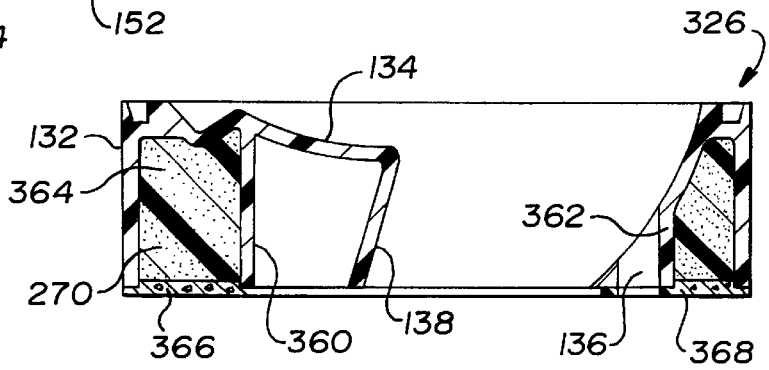
FIG. 13 is a vertical sectional view of a floating disk similar to that shown in FIG. 10 but in accordance with another embodiment of the present invention.
Figure 14:
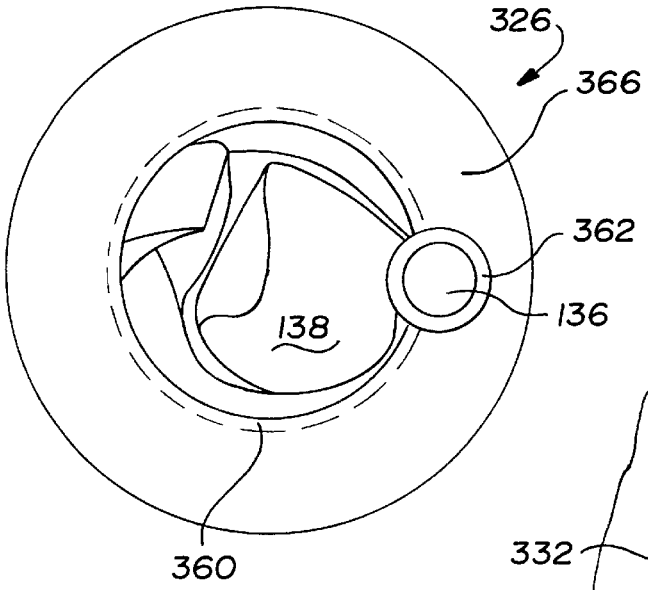
FIG. 14 is a bottom view of the floating disk shown in FIG. 13.

Referring now to FIGS. 13 and 14, there is shown a floating disk 326 in accordance with another embodiment of the present invention. Floating disk 326 includes outer cylindrical wall 132, contoured or cam surface 134, straw aperture 136 and central aperture 138. Cam surface 134 defines first contoured surface 150 and second contoured surface 152. Contoured surfaces 150 and 152 form a bi-directional cam surface which will rotate floating disk 326 clockwise or counter-clockwise depending on whether contoured surface 150 or contoured surface 152 is engaged by closure tab 122. The incorporation of contoured surface 150 and contoured surface 152 limits the maximum amount of rotation of floating disk 326 to a range from about 180° to about 210° or about 192° in order to align straw 130 with orifice 120. Ridge 154 separates contoured surface 150 from contoured surface 152 at one end while the opposite ends of surfaces 150 and 152 blend together as shown in the drawings.

Floating disk 326 is similar to floating disk 226 except that floating disk 326 incorporates additional features. An annular wall 360 extend between cam surface 134 and the lower ridge of floating disk 326. In addition, an annular wall 362 extends between straw aperture 136 and the lower edge of floating disk 326. Annular wall 360, annular wall 362 and outer cylindrical wall 132 define an annular chamber 364. Annular chamber 364 can be used to house foam material 270 as shown in FIG. 13 or annular chamber 326 can be left empty and covered with an annular ring 366 to close chamber 364 thus providing an air chamber to improve the buoyancy of floating disk 326. Annular ring 366 may also be used to cover foam material 270 if desired. When floating disk 326 is being utilized in a carbonated beverage container, the material selected for floating disk 326 and/or annular ring 366 can allow permeation of the carbon dioxide through the material to equalize the pressure between chamber 364 and the inside of can 110. Then, when can 110 is opened and the pressure within is relieved, chamber 364 will become a pressurized chamber to enhance the buoyancy of floating disk 326. Annular ring 366 can be utilized as a temporary holding device to hold floating disk 326 down in the bottom of can 110 during the filing process. Annular ring 366 can be formed having a plurality of particles 368 dispersed within ring 366. Particles 368 can either have magnetic capability and/or can become magnetized by using an appropriate electric field. When the open can 110 is located on a steel trackwork system for filling, particles 368 will be attracted to the trackwork system to hold floating disk 326 at the bottom of can 110. The electric field is maintained from just prior to filling, through the filling and closing operations. It is also possible to reverse the magnetic hold down system described above by making particles 368 from a ferrous material and having the trackwork system include a magnetic material and/or field during the filling and closing operations.

Figure 15:
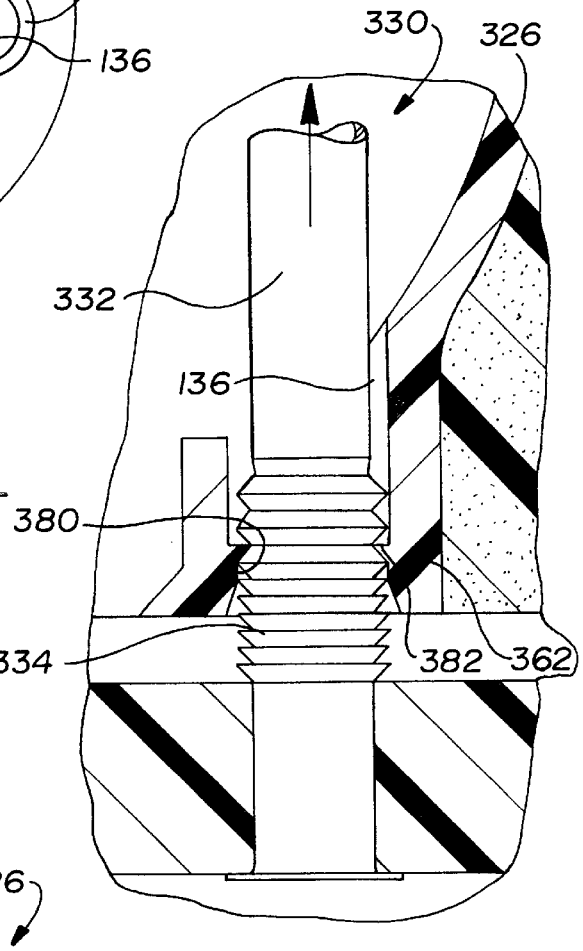
FIG. 15 is an enlarged cross-sectional view of the straw sleeve shown in FIGS. 10 and 13.

Referring now to FIGS. 13–15, annular wall 362 extends between straw aperture 136 and the lower edge of floating disk 326 to provide a cylindrical guiding surface 380 and thus support for a straw 330. The internal configuration of surface 380 facilitates the removal and use of straw 330. Straw 330 comprises a straight portion 332 and a multi-pleated section 334. Multi-pleated section 334 is designed to unfold when straw 330 is pulled by the consumer to allow straw 330 to extend from the bottom of can 110 through orifice 120 for the convenience of the consumer. Cylindrical guiding surface 380 defines a step 382 which engages multi-pleated section 334. The inside diameter of step 382 is designed to be slightly greater than the outside diameter of straight portion 332 and slightly less than the outside diameter of multi-pleated section 334. Thus, when can 110 is opened, straw 330 will slide through step 382. The consumer can then pull on the exposed end of straw 330 which will cause each individual pleat of multi-pleated section 334 to open and increase the length of straw 330 in order to be able to pass through step 382. Once all of the pleats of multi-pleated section 334 have opened, a stop on the end of straw 330 can prevent removal of straw 330 from floating disk 326 if desired. The stop can be formed into the end of straw 330 and/or the float used to raise straw 330 can act as a stop.

Figure 16:
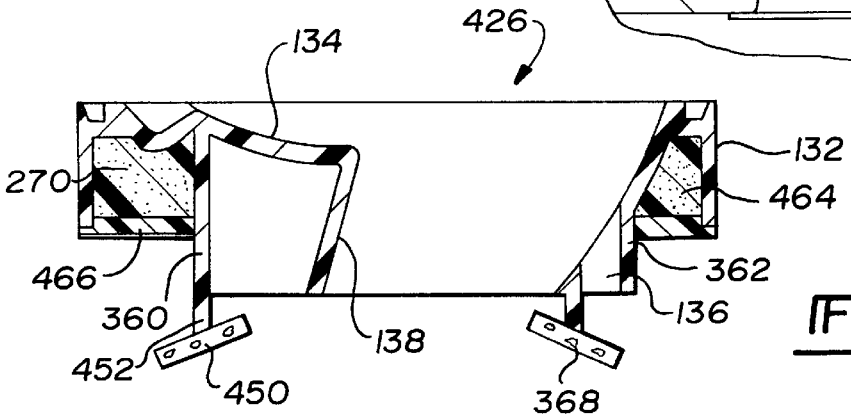
FIG. 16 is a vertical sectional view of a floating disk similar to that shown in FIG. 13 but in accordance with another embodiment of the present invention.

Referring now to FIG. 16, there is shown a floating disk 426 in accordance with another embodiment of the present invention. Floating disk 426 includes outer cylindrical wall 132, contoured or cam surface 134, straw aperture 136 and central aperture 138. Cam surface 134 defines first contoured surface 150 and second contoured surface 152. Contoured surfaces 150 and 152 form a bi-directional cam surface which will rotate floating disk 426 clockwise or counter-clockwise depending on whether contoured surface 150 or contoured surface 152 is engaged by closure tab 122. The incorporation of contoured surface 150 and contoured surface 152 limits the maximum amount of rotation of floating disk 426 to a range of about 180° to about 210° or about 192° in order to align straw 130 with orifice 120. Ridge 154 separates contoured surface 150 from contoured surface 152 at one end while the opposite ends of surfaces 150 and 152 blend together as shown in the drawings.

Floating disk 426 is similar to floating disk 326 in that it includes annular wall 360 and annular wall 362. The differences between floating disk 426 and floating disk 326 include the length of outer cylindrical wall 132 and the addition of a plurality of pads 450, each attached to an extension 452 of annular wall 360. Extension 452 can be an annular extension around the entire circumference of annular wall 360 or each pad 450 can be attached to a separate extension. Annular wall 360, annular wall 362 and shortened outer cylindrical wall 132 define an annular chamber 464. Similar to annular chamber 364, annular chamber 464 can be used to house foam material 270 as shown in FIG. 16 or annular chamber 426 can be left empty and covered with an annular ring 466 to close chamber 426 thus providing an air chamber to improve the buoyancy of floating disk 426. Annular ring 466 may also be used to cover foam material 270 if desired. Similar to floating disk 326, when floating disk 426 is being utilized in a carbonated beverage container, the material selected for floating disk 426 and annular ring 466 can allow permeation of the carbon dioxide through the material to equalize the pressure between chamber 464 and the inside of can 110. Then, when can 110 is opened and pressure within can 110 is relieved, chamber 464 will become a pressurized chamber to enhance the buoyancy of floating disk 426.

The length of outer cylindrical wall 132 can be made shorter because of the added buoyancy provided by chamber 464. A benefit of the shorter length of wall 132 is the ease of insertion of floating disk 426 into can 110. When floating disk 326 is inserted into can 110, floating disk 326 must be generally vertically aligned with can 110 to avoid interference between the two. The generally vertical alignment is required due to the length of wall 132. When wall 132 is reduced in length as shown for floating disk 426, a non-vertical alignment between floating disk 426 and can 110 can be utilized for the insertion of floating disk 426. This non-vertical alignment allows floating disk 426 to be inserted into can 110 in a twisting motion which can facilitate the manufacturing process for assembly of floating disk 426 into can 110.

When a shorter wall 132 such as shown on floating disk 426 is used, annular ring 466 is located away from the lower end of floating disk 426 making it impractical to incorporate the magnetic hold down feature described above for can disk 326. The incorporation of extension 452 and pads 450 allow for the utilization of the magnetic hold down feature. Pads 450 are manufactured incorporating the plurality of particles 368. In addition, pads 450 are positioned at an angle as shown in FIG. 16 such that they will coincide with and thus engage the typical domed bottom of can 110. The function and operation of cam disk 426 is the same as described above.

Referring now to FIG. 17, there is shown a floating disk 526 in accordance with another embodiment of the present invention. Floating disk 526 includes outer cylindrical wall 132, contoured or cam surface 134, straw aperture 136 and central aperture 138. Cam surface 134 defines first contoured surface 150 and second contoured surface 152. Contoured surfaces 150 and 152 form a bi-directional cam surface which will rotate floating disk 526 clockwise or counter-clockwise depending on whether contoured surface 150 or contoured surface 152 is engaged by closure tab 122. The incorporation of contoured surface 150 and contoured surface 152 limits the maximum amount of rotation of floating disk 526 to a range of about 180° to about 210° or about 192° in order to align straw 130 with orifice 120. Ridge 154 separates contoured surface 150 from contoured surface 152 at one end while the opposite ends of surfaces 150 and 152 blend together as shown in the drawings.

Floating disk 526 is the same as floating disk 426 with the exception that annular ring 466 is replaced with an annular ring 566. Annular ring 566 is a curved ring which increases the size of a chamber 564 thus increasing the buoyancy of floating disk 526. Annular ring 566 is thus able to increase the buoyancy of floating disk 526 while still allowing for the non-vertical assembly of floating disk 526 into can 110 as described above. The features, function and operation of cam disk 526 is the same as those described above.

Referring now to FIGS. 18 and 19, there is shown a floating disk 626 in accordance with another embodiment of the present invention. Floating disk 626 includes outer cylindrical wall 132, contoured or cam surface 134, straw aperture 136 and central aperture 138. Cam surface 134 defines first contoured surface 150 and second contoured surface 152. Contoured surfaces 150 and 152 form a bi-directional cam surface which will rotate floating disk 626 clockwise or counter-clockwise depending on whether contoured surface 150 or contoured surface 152 is engaged by closure tab 122. The incorporation of contoured surface 150 and contoured surface 152 limits the maximum amount of rotation of floating disk 626 to a range of about 180° to about 210° or about 192° in order to align straw 130 with orifice 120. Ridge 154 separates contoured surface 150 front contoured surface 152 at one end while the opposite ends of surfaces 150 and 152 blend together as shown in the drawings.

Floating disk 626 is similar to floating disk 426 and it is illustrated without having extensions 452 and pads 450. It is within the scope of the present invention to include extensions 452 and pads 450 with floating disk 626 if desired. Floating disk 626 includes an undercut area 630 which extends along with circumference of outside cylindrical wall 132 and which eliminates a portion of annular ridge 260 as well as a portion of cylindrical wall 132. Undercut area 630 extends for approximately 90° of the circumference and is located generally opposite to straw aperture 136. Undercut area 630 improves the function and operation of floating disk 626 by enhancing the draining of liquid from channel 262 into which lid 116 seats and by permitting lid 116 to beneficially slide out of channel 262 while working in concert with buoyant member 128 on straw 130 to enable tab 122 to successfully negotiate moving around cam surface 134 until straw 130 finds orifice 120 of lid 116.

It is to be understood that annular wall 360 may have a length suitable to the practice of this invention in all of the above described embodiments, such that wall 360 is incorporated into floating disks 226, 326, 426 or 526 such that wall 360 extends below aperture 138 defined by cam surface 134.

Likewise, it is to be understood that annular wall 362 is ideally the same length as annular wall 360 so that they form a continuous bottom surface. However, for the practice of this invention, annular wall 362 may be shorter or longer than annular wall 360 to accommodate multi-pleated section 334 or buoyant member 128 in all of its embodiments and that this feature extends to floating disks 226, 326, 426 or 526.

Figure 20:
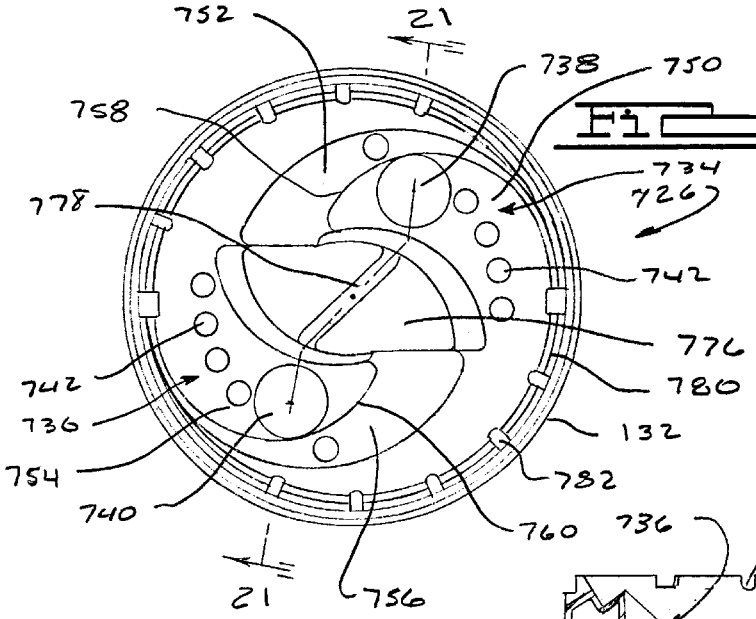
FIG. 20 is a top view of a floating disc in accordance with another embodiment of the present invention.
Figure 21:
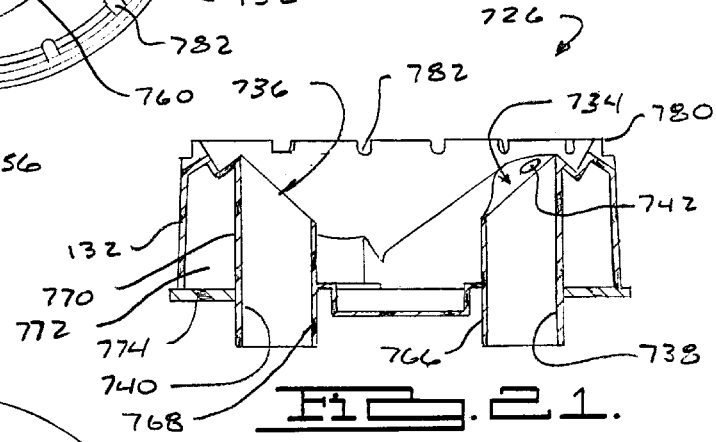
FIG. 21 is a vertical sectional view of the floating disc shown in FIG. 20.
Figure 22:
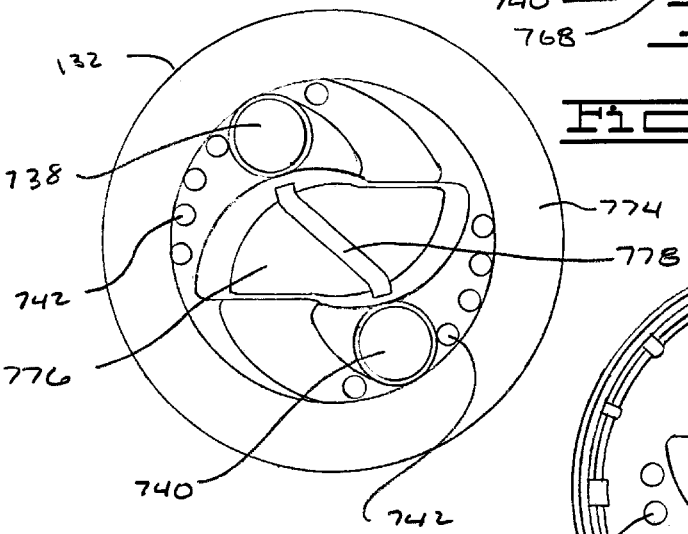
FIG. 22 is a bottom view of the floating disc shown in FIG. 20.

Referring now to FIGS. 20–22, there is shown a floating member 726 in accordance with another embodiment of the present invention. Floating member 726 includes outer cylindrical wall 132, a first contoured or cam surface 734, a second contoured or cam surface 736, a first straw aperture 738, a second straw aperture 740 and a plurality of venting holes 742. First cam surface 734 defines a first contoured surface 750 and a second contoured surface 752. Second cam surface 736 also defines a first contoured surface 754 and a second contoured surface 756. Contoured surface 750 in conjunction with contoured surface 752 forms a bi-directional cam surface which will rotate floating member 726 clockwise or counter-clockwise depending on whether contoured surface 750 or contoured surface 752 is engaged by closure tab 122. In a similar manner, contoured surface 754 in conjunction with contoured surface 756 forms a bi-directional cam surface which will rotate floating member 726 clockwise or counter-clockwise depending on whether contoured surface 754 or contoured surface 756 is engaged by closure tab 122. The incorporation of two pairs of contoured surfaces, 750 with 752 and 754 with 756 limits the maximum amount of rotation of floating member 726 to a range from about 180° to about 210° or about 192° in order to align a respective straw 130 with orifice 120. A directional ridge 758 separates contoured surface 750 from contoured surface 752 and a directional ridge 760 separates contoured surface 754 from contoured surface 756. At the opposite end, contoured surface 750 blends with contoured surface 756 and contoured surface 752 blends with contoured surface 754 as shown in FIG. 20.

Floating member 726 includes the pair of dramatically opposed straw apertures 738, 740 which are located adjacent ridges 758 and 760, respectively. Aperture 738 is defined by a cylindrical wall 766 and aperture 740 is defined by a cylindrical wall 768. Both cylindrical wall 766 and 768 extend axially beyond the lower surface of outer cylindrical wall 132 as shown in FIG. 21. Apertures 738 and 740 are designed to each accept a respective straw 130 similar to aperture 136. Floating member 726 further includes an annular wall 770 which extends from cam surfaces 734 and 736 generally parallel to outer cylindrical wall 132. Annular wall 770 and cylindrical wall 132 terminate at the same axial position to define a chamber 772. An annular ring 774 is secured to annular wall 770 and cylindrical wall 132 to close and seal chamber 772. Chamber 772, filled with air, increases the buoyancy of floating member 726. Annular ring 774 is secured to walls 132 and 770 preferably by ultrasonic welding but it is within the scope of the present invention to use other methods of securing annular ring 774 to walls 132 and 770 including gluing, hot melting, friction welding or any other method known in the art.

The plurality of venting holes 742 extend through cam surface 734 and cam surface 736 to provide a mechanism for air to escape from under floating member 726 during the filling operation. When the container within which floating member 726 is located is filled with the appropriate fluid, the fluid will flow under floating member 726 through a central aperture 776. As the container fills with the fluid, air located below cam surfaces 734 and 736 is allowed to escape through holes 742. Central aperture 776 extends through floating member 726 between cam surface 734 and cam surface 736. A longitudinal member 778 extends between cam surface 734 and cam surface 736 to facilitate the molding of floating member 726.

At the top of cylindrical wall 132 on floating member 726, an annular ridge 780 extends upwardly to engage the inner surface of annular flange 264 shown in FIG. 10. Annular ridge 780 includes a plurality of gaps 782 which allow any gas trapped between floating member 726 and the can lid to escape as well as reducing or eliminating any suction induced adhesion of disk 726 to the can lid.

When the beverage can is filled with the appropriate fluid, the fluid will flow through central aperture 776 to the position below floating member 726 which initially rests on the bottom of the container. To facilitate the filling of the container, holes 742 allow any air trapped beneath floating member 726 to escape during the fill operation. After the container has been closed by the lid, floating member 726 will float to the top of the container to engage the lid with annular ridge 780 nesting within annular flange 264. The circumferential positioning of the two straw apertures 738 and 740 and thus the two straws 130 will be random due to the filling and seaming operation.

During the opening of the container, closure tab 122 is deflected inward to engage one of the four contoured surfaces 750, 752, 754 or 756. This engagement imparts rotational movement to floating member 726, buoyant members 128 and straws 130. This rotating movement will eventually cause either straw aperture 738 or 740 to align with orifice 120. Once aligned with orifice 120, buoyant member 128 associated with the straw 130 in the aligned aperture 738 or 740 will raise straw 130 through orifice 120 making it accessible to the user. In order to ensure rotational movement of floating member 726 and to avoid excessive tipping of floating member 726, straws 130 and buoyant members 128 act as a torque arm to stabilize floating member 726 and limit the amount of its tipping. As detailed above, the diameter of floating member 726 is designed to be slightly smaller than the inside diameter of the container and the radial position of straw apertures 738 and 740 are chosen such that they are in direct vertical alignment with orifice 120 when either aperture 738 or 740 is circumferentially aligned with orifice 120.

Figure 23:
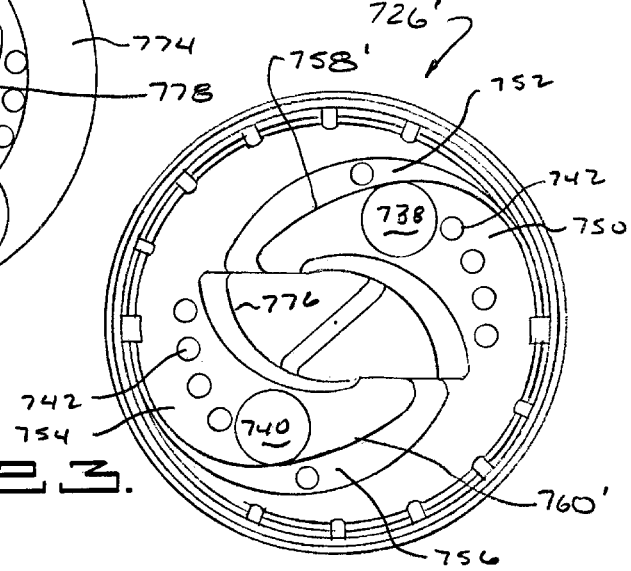
FIG. 23 is a top view of a floating disc in accordance with another embodiment of the present invention.

Referring now to FIG. 23, there is shown a floating member 726' in accordance with another embodiment of the present invention. Floating member 726' is identical to floating member 726 except that directional ridge 758 has been replaced with a directional ridge 758' and directional ridge 760 has been replaced with a directional ridge 760'. Beverage can 110 has been illustrated with upper lid 116 which includes lever ring 118, orifice 120 and closure tab 122. Closure tab 122 and thus orifice 120 have been illustrated as one design of an orifice that is typically used in the beverage container industry. The design for closure tab 122 and thus orifice 120 illustrated is not the only design being utilized in the industry. Other designs, such as the wide mouth designs, are being made available. Floating member 726' is an illustration of the design changes which may be needed to tailor the floating member to the specific tab design. In this case, directional ridges 758 and 760 were redesigned as shown by directional ridges 758' and 760' to accommodate the "wide mouth" design for tab 122 and thus orifice 120.

While the above detailed description describes the preferred embodiment of the present invention, it should be understood that the present invention is susceptible to modification, variation and alteration without deviating from the scope and fair meaning of the subjoined claims.

What is claimed is:

1. A beverage container comprising:

a body with a closed bottom end and a top end;

a lid closing said top end of said body, said lid defining an orifice;

a closure tab disposed within said orifice;

a floating member disposed within said body, said floating member being disposed adjacent said lid when a liquid is disposed within said container, said floating member having a first cylindrical wall defining a first straw aperture, a second cylindrical wall defining a second straw aperture and an outer cylindrical wall disposed around said first and second cylindrical walls and said first, second cylindrical walls extending at least as far in an axial direction as said outer cylindrical wall;

a first straw disposed within said first straw aperture;

a second straw disposed within said second straw aperture; and means for deflecting said closure tab into said container to open said orifice, said closure tab engaging said floating member to move said floating member and thereby align one of said first and second straws with said orifice.

2. The beverage container according to claim 1, wherein said outer cylindrical wall includes an annular ridge.

3. The beverage container according to claim 1, wherein said floating member defines a contoured surface for engagement with said closure tab.

4. The beverage container according to claim 3, wherein said floating member defines at least one hole extending through said contoured surface.

5. A beverage container comprising:

a body with a closed bottom end and a top end;

a lid closing said top end of said body, said lid defining an orifice;

a closure tab disposed within said orifice;

a floating member disposed within said body, said floating member being disposed adjacent said lid when a liquid is disposed within said container, said floating member having a first cylindrical wall defining a first straw aperture and a second cylindrical wall defining a second straw aperture;

a first straw disposed within said first straw aperture;

a second straw disposed within said second straw aperture; and means for deflecting said closure tab into said container to open said orifice, said closure tab engaging said floating member to move said floating member and thereby align one of said first and second straws with said orifice;

wherein said floating member has an outer cylindrical wall disposed around said first and second cylindrical walls and said first and second cylindrical walls extend further in an axial direction than said outer cylindrical wall.

6. A beverage container comprising:

a body with a closed bottom end and a top end;

a lid closing said top end of said body, said lid defining an orifice;

a closure tab disposed within said orifice;

a floating member disposed within said body, said floating member being disposed adjacent said lid when a liquid is disposed within said container, said floating member having a first cylindrical wall defining a first straw aperture and a second cylindrical wall defining a second straw aperture;

a first straw disposed within said first straw aperture;

a second straw disposed within said second straw aperture; and means for deflecting said closure tab into said container to open said orifice, said closure tab engaging said floating member to move said floating member and thereby align one of said first and second straws with said orifice;

wherein said floating member has an outer cylindrical wall disposed around said first and second cylindrical walls, said outer cylindrical wall includes an annular ridge and said annular ridge defines a plurality of gaps circumferentially disposed around said annular ridge.

7. A beverage container comprising:

a body with a closed bottom end and a top end;

a lid closing said top end of said body, said lid defining an orifice;

a closure tab disposed within said orifice;

a floating member disposed within said body, said floating member being disposed adjacent said lid when a liquid is disposed within said container, said floating member having a first cylindrical wall defining a first straw aperture and a second cylindrical wall defining a second straw aperture;

a first straw disposed within said first straw aperture;

a second straw disposed within said second straw aperture; and means for deflecting said closure tab into said container to open said orifice, said closure tab engaging said floating member to move said floating member and thereby align one of said first and second straws with said orifice;

wherein said floating member defines a closed chamber.

8. The beverage container according to claim 7, wherein said closed chamber is an annular chamber.

9. The beverage container according to claim 8, wherein said annular chamber surrounds said first and second straw apertures.

10. A beverage container comprising:

a body with a closed bottom end and a top end;

a lid closing said top end of said body, said lid defining an orifice;

a closure tab disposed within said orifice;

a floating member disposed within said body, said floating member being disposed adjacent said lid when a liquid is disposed within said container, said floating member defining a contoured surface for engagement with said closure tab and at least one hole extending through said contoured surface;

a straw associated with said floating member; and means for deflecting said closure tab into said container to open said orifice, said closure tab engaging said contoured surface of said floating member to move said floating member and thereby align said straw with said orifice.

11. The beverage container according to claim 10, wherein said floating member has an outer cylindrical wall disposed around said contoured surface.

12. The beverage container according to claim 11, wherein said outer cylindrical wall includes an annular ridge.

13. The beverage container according to claim 12, wherein said annular ridge defines a plurality of gaps circumferentially disposed around said annular ridge.

14. The beverage container according to claim 10, wherein said floating member defines a closed chamber.

15. The beverage container according to claim 14, wherein said closed chamber is an annular chamber.

16. The beverage container according to claim 15, wherein said annular chamber surrounds said contoured surface.

17. A beverage container comprising:

a body with a closed bottom end and a top end;

a lid closing said top end of said body, said lid defining an orifice;

a closure tab disposed within said orifice;

a floating member disposed within said body, said floating member being disposed adjacent said lid when a liquid is disposed within said container, said floating member defining a first, a second, a third and a fourth contoured surface;

a first straw associated with said floating member; and means for deflecting said closure tab into said container to open said orifice, said closure tab engaging at least one of said first, second, third and fourth contoured surfaces to move said floating member and thereby align said straw with said orifice.

18. The beverage container according to claim 17, wherein engagement between said closure tab and said first contoured surface causes clockwise rotation of said floating member and engagement between said closure tab and said second contoured surface causes counterclockwise rotation of said floating member.

19. The beverage container according to claim 18, wherein engagement between said closure tab and said third contoured surface causes clockwise rotation of said floating member and engagement between said closure tab and said fourth contoured surface causes counterclockwise rotation of said floating member.

20. The beverage container according to claim 17, wherein said floating member includes a cylindrical wall defining a straw aperture, said first straw being disposed within said first straw aperture.

21. The beverage container according to claim 17, further comprising a second straw associated with said floating member.

22. The beverage container according to claim 21, wherein said floating member defines a first cylindrical wall defining a first straw aperture and a second cylindrical wall defining a second straw aperture, said first straw being disposed within said first straw aperture, said second straw being disposed within said second straw aperture.

23. The beverage container according to claim 22, wherein said floating member has an outer cylindrical wall disposed around said first and second cylindrical walls.

24. The beverage container according to claim 23, wherein said first and second cylindrical walls extend further in an axial direction than said outer cylindrical wall.

25. The beverage container according to claim 23, wherein said outer cylindrical wall includes an annular ridge.

26. The beverage container according to claim 25, wherein said annular ridge defines a plurality of gaps circumferentially disposed around said annular ridge.

27. The beverage container according to claim 22, wherein said floating member defines a closed chamber.

28. The beverage container according to claim 27, wherein said closed chamber is an annular chamber.

29. The beverage container according to claim 28, wherein said annular chamber surrounds said first and second straw apertures.

30. The floating member according to claim 17, wherein said floating member defines at least one hole extending through at least one of said contoured surfaces.

31. The floating member according to claim 17, wherein said floating member defines at least one hole extending through each of said contoured surfaces.

* * * * *